United States Patent [19]

Van Meter

[11] 4,132,307

[45] Jan. 2, 1979

[54] MATCHBOOK STRUCTURE

[76] Inventor: James A. Van Meter, 15357 Magnolia Blvd., Van Nuys, Calif. 91403

[21] Appl. No.: 661,507

[22] Filed: Feb. 26, 1976

Related U.S. Application Data

[63] Continuation of Ser. No. 499,487, Aug. 22, 1974, abandoned.

[51] Int. Cl.[2] ..... A24F 27/00

[52] U.S. Cl. ..... 206/115

[58] Field of Search ..... 206/104, 106–109, 206/111, 115; 229/44 R

[56] References Cited

U.S. PATENT DOCUMENTS

| | | | |
|---|---|---|---|
| 1,858,704 | 5/1932 | Freedman | 206/115 |
| 1,939,567 | 12/1933 | O'Malley | 206/115 |
| 2,118,634 | 5/1938 | Williams | 206/104 |
| 2,286,533 | 6/1942 | Gartelman | 206/115 |
| 2,311,794 | 2/1943 | Warner | 206/104 |
| 2,620,920 | 12/1952 | Hill | 206/115 |
| 2,763,368 | 9/1956 | Malek | 206/115 |
| 2,765,072 | 10/1956 | Will | 206/115 |
| 3,129,809 | 4/1964 | Sternau | 206/115 |
| 3,333,760 | 8/1967 | Bridenstine | 229/44 R |
| 3,871,517 | 3/1975 | Cioffi | 206/115 X |

*Primary Examiner*—Steven E. Lipman
*Attorney, Agent, or Firm*—Robert E. Geauque

[57] ABSTRACT

A matchbook structure wherein a protective cover is employed which is to protect the sides of the book of matches from being contacted by a spark from the lighting of a single match. The protective cover is connected to the base of the matchbook which is an extension of the back of the matchbook. The striking surface may be on the protective cover, the outer cover or the extension. The protective cover may be made of transparent material, if desired.

1 Claim, 9 Drawing Figures

MATCHBOOK STRUCTURE

This is a continuation of application Ser. No. 499,487, filed Aug. 22, 1974, now abandoned.

BACKGROUND OF THE INVENTION

The field of this invention is in safety matchbooks.

Conventional safety matchbooks are open on both sides thereby exposing the match heads. It is quite possible that a spark may be carried by the wind contacting a match head or due to the explosive action of the igniting match head and resulting in the unexpected ignition of the entire matchbook. This unexpected ignition of the entire matchbook has, in the past, caused serious burns of persons and loss of property.

A separate matchbook holder could prevent the hazard of a conventional matchbook, but however, most people prefer to use only a matchbook and not a matchbook holder.

Previously, there has been no known attempt to design a conventional matchbook to include a protective cover which absolutely protective cover which absolutely prohibits the accidental igniting of the entire matchbook.

SUMMARY OF THE INVENTION

The structure of this invention is believed to be adequately described in the Abstract Of The Disclosure and reference is to be had thereto.

It is the primary object of the present invention to provide a safety matchbook having means for encasing and protecting the match heads. Other objects of the present invention are to make a more attractive match book; to make lighting a match faster than in reverse ignition as is the trend for more safety (though doubtful); to prevent match stub closure difficulty and to confuse children from playing with matches.

The structure of this invention causes only a minor increase in cost of the conventional safety matchbook and can be easily manufactured along with manufacture of the conventional matchbook. The structure of this invention could regain users of lighters thereby increasing the sale of matchbooks.

BRIEF DESCRIPTION OF THE SHOWN EMBODIMENTS

Figure 1:
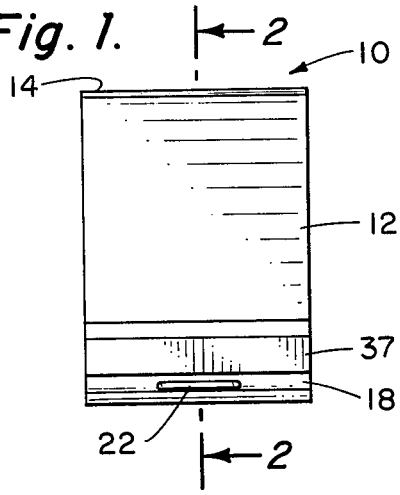
FIG. 1 is a front view of the first embodiment of the matchbook structure of this invention.

The matchbook 10 of this invention is employed in conjunction with a conventional matchbook which comprises a sheet material outer cover 12 which is integrally secured through a top 14 to a back 16. The lower edge of the back 16 is extended to form an extension 18 which is folded over upon a portion of the back 16. A grouping of matches 20 are positioned between the extension 18 and the back 16 and secured by means of a staple 22.

Figure 2:
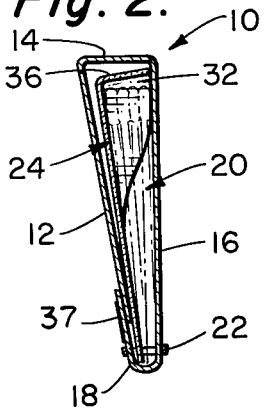
FIG. 2 is a cross-sectional view taken along line 2—2 of FIG. 1.
Figure 3:
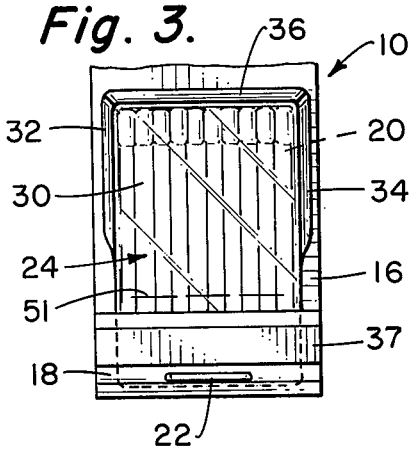
FIG. 3 is a front view of the matchbook structure of this invention with the outer cover in the open position.
Figure 4:
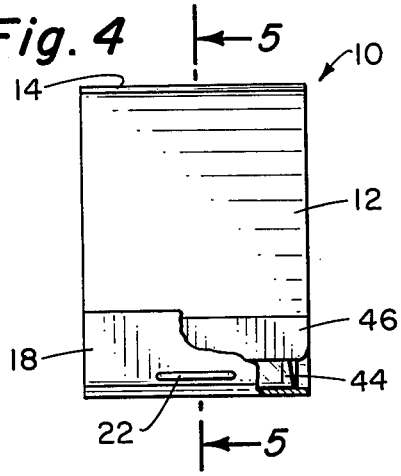
FIG. 4 is a front view of the second embodiment of the matchbook structure of this invention.
Figure 5:
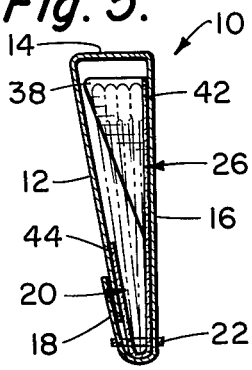
FIG. 5 is a cross-sectional view taken along line 5—5 of FIG. 4.
Figure 6:
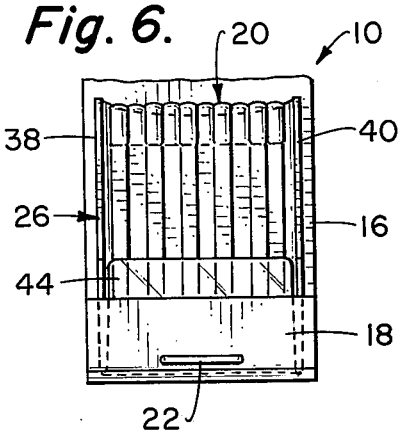
FIG. 6 is a front view of the second embodiment of the matchbook structure of this invention showing the cover in the open position.
Figure 7:
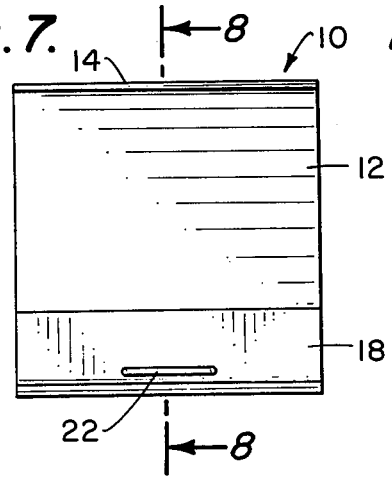
FIG. 7 is a front view of the third embodiment of the matchbook structure of this invention.
Figure 8:
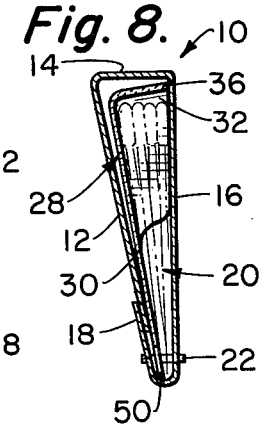
FIG. 8 is a cross-sectional view taken along line 8—8 of FIG. 7.
Figure 9:
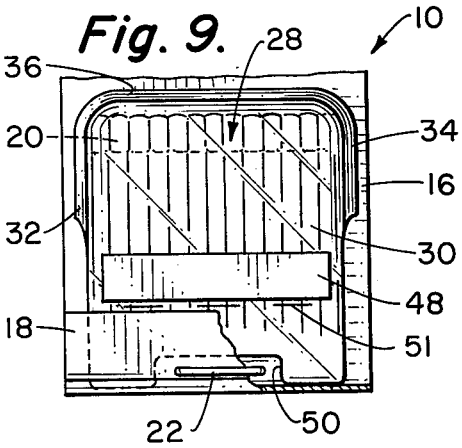
FIG. 9 is a front view of the third embodiment of the matchbook structure of this invention showing the cover in the open position.

The structure of this invention is particularly directed to the use of a protective cover which is shown in FIGS. 1 to 3 as numeral 24, and FIGS. 4 to 6 as numeral 26 and in FIGS. 7 to 9 as numeral 28. The protective covers 24, 26 and 28 are each shown formed of a transparent plastic material. However, the covers could be formed of any type of sheet material, opaque or transparent.

The cover 24 includes a main section 30, side panels 32 and 34 and a top panel 36. The top panel 36 and the side panels 32 and 34 are adapted to enclose the match grouping 20, specifically the head portion of the match grouping. The lower edge of the main section 30 of the protective cover 24 is secured to the overall structure by means of the staple 22. Within the structure shown in FIGS. 1 to 3, the match striking surface 36 is attached to the outer portion of the extension 18.

The operation of the structure in FIGS. 1 to 3 is that when the outer cover 12 is moved from the closed position to the open position, the operator then pivots along the slotted hinge line 51 of the protective cover 24 in an outward direction sufficiently as to permit entry to the matches 20 and effect removal of a single match. The protective cover 24 is then permitted to deflect back to its normal position about the match heads and the operator can then strike the match upon the striking surface 36 without fear of any spark therefrom causing ignition of the remaining match heads.

Referring particular to FIGS. 4 to 6, the protective cover 26 includes side panels 38 and 40 which are connected to a main section 42, the main section being disposed between the grouping 20 of the matches and the back 16. The main section 42 is extending to form an extended section 44, the extended section 44 folding over upon itself and lying against the front surface of the grouping 20 of the matches. The staple 22 secures in position the protective cover 26. The extended section 44 prevents match stubs from making it difficult to slip the cover 12 into a closed position behind the extension 18.

The striking surface 46 within the structure of FIGS. 4 to 6 is mounted upon the outer cover 12 and it is only because of this that the cover 12 must be closed against the extended section 44 in order to effect striking of the match. When this is accomplished, the side panels 38 and 40, as well as the cover 12 and the back 16, completely encase the grouping 20 of the matches, thereby preventing a spark from the ignited match igniting the remaining matches.

Referring particularly to FIGS. 7 to 9, the protective cover 28 is basically of the same configuration of that of FIGS. 1 to 3 and like numerals have been employed to refer to like parts. However, the striking surface 48 is mounted upon the main section 30 of the cover 28. The base edge of the main section 28 includes a U-shaped recess 50. This recess 50 causes the protective cover 28 to be disengaged from the area between the extension 18 and the match grouping 20. Therefore, the protective cover 28 can be removed from one conventional matchbook structure to another conventional matchbook structure since the cover 28 is only frictionally held between the extension 18 and the grouping 20 of the matches.

The operation of the cover 28 is accomplished in the same manner as cover 24 and it only being that the outer cover 12 need not be closed to effect striking of the match. Actually, the outer cover must be not closed and the striking of the match is accomplished directly on the outer surface of the cover 28.

What is claimed is:

1. A matchbook structure comprising:

a sheet material back;

a sheet material cover, said cover movable from a closed position to an open position;

a grouping of matches, with said cover in said open position access for removal of one or more said matches is provided;

said back having an extension at its base edge which is bent over and secured by securing means to the base ends of said matches;

the improvement comprising:

a substantially rigid plastic protective cover to protect the heads of the grouping of matches from being ignited upon the ignition of a single match, said protective cover having a main section and side panels, said main section located directly adjacent said sheet material cover, said side panels substantially extending between said back and said cover when said cover is in said closed position, one each of said side panels located on each side of the heads of the matches forming a single match encasing compartment, said protective cover connected with said extension;

said protective cover being transparent;

said cover including a line of several slits adjacent said extension to act as a hinge to assist pivoting the cover between the open and closed position; said main section having a base edge, said base edge having a U-shaped recess, said protective cover being inserted within said matchbook structure with said securing means located within said U-shaped recess not in contact with said base edge, said base edge of said cover being frictionally held between said base ends of said matches and said extension thereby permitting removal of said cover and reinstallation within another matchbook.

* * * * *